US007322538B1

(12) United States Patent
Gruhlke et al.

(10) Patent No.: US 7,322,538 B1
(45) Date of Patent: Jan. 29, 2008

(54) SLAG CRUSHER

(75) Inventors: Wolfram Gruhlke, Toenisvorst (DE); Hans-Otto Ramm, Wesel (DE)

(73) Assignee: Metallgesellschaft AG, Frnakfurt am Main (DE)

( * ) Notice: Subject to any disclaimer, the term of this patent is extended or adjusted under 35 U.S.C. 154(b) by 0 days.

(21) Appl. No.: 09/554,781

(22) PCT Filed: Nov. 26, 1998

(86) PCT No.: PCT/EP98/07619

§ 371 (c)(1),
(2), (4) Date: Apr. 16, 2001

(87) PCT Pub. No.: WO99/28413

PCT Pub. Date: Jun. 10, 1999

(30) Foreign Application Priority Data

Nov. 27, 1997 (DE) ..... 197 52 538

(51) Int. Cl.
*B02C 18/16* (2006.01)

(52) U.S. Cl. ..... 241/166; 241/243; 241/300

(58) Field of Classification Search ..... 241/243, 241/166, 167, 300
See application file for complete search history.

(56) References Cited

U.S. PATENT DOCUMENTS

| | | | | |
|---|---|---|---|---|
| 3,897,015 | A | 7/1975 | Suzuki | |
| 4,486,199 | A | 12/1984 | Schenone | |
| 4,601,430 | A | 7/1986 | Skinner | |
| 4,738,687 | A | 4/1988 | Smieskol et al. | |
| 5,148,996 | A * | 9/1992 | Fletcher et al. | 241/36 |
| 5,454,522 | A * | 10/1995 | Ballu | 241/237 |

FOREIGN PATENT DOCUMENTS

WO 86/05198 A 9/1986

OTHER PUBLICATIONS

Patent Abstracts of Japan, vol. 097, No. 008, dated Aug. 29, 1997 & JP 09 095685 A (Babcock Hitachi), dated Apr. 8, 1997.

* cited by examiner

*Primary Examiner*—Mark Rosenbaum
(74) *Attorney, Agent, or Firm*—Norris McLaughlin & Marcus PA

(57) ABSTRACT

Slag crusher having a shaft extending through a pressure housing which shaft is provided with inlet baffle plates in a funnel-shaped arrangement, stationary cutting knives and cutting knives rotating on the shaft. The shaft is offset with respect to the vertical center line of the pressure housing, so that the crushing area is concentrated in the middle of the slag crusher. The rotating cutting knives are angularly offset on the periphery of the shaft, so that only one rotating knife and two stationary knives are in engagement at a time.

3 Claims, 5 Drawing Sheets

Section A - B

Section A - B

Section C - D

View E

SLAG CRUSHER

This is a 371 of PCT/EP98/07619 filed 26 Nov. 1998 (international filing date).

This invention relates to a slag crusher at the outlet of a radiation cooler or gasification reactor with quenching section, comprising a flooded pressure housing as well as a shaft extending through the housing and comprising rotating cutting knives, inlet baffle plates in a funnel-shaped arrangement, and stationary cutting knives.

BACKGROUND OF THE INVENTION

Slag crushers are used for crushing lumpy mineral slags and unburnt residues, as they are produced in combustion processes or in the gasification of coal.

From DE 42 20 265 C1 there is known an apparatus for producing gas to be used in firing plants.

The apparatus comprises a reactor housing that is water-cooled with respect to its wall portions. Inside the reactor housing there is disposed a stepped reactor bottom carrying the material to be gasified, which reactor bottom is divided into several stationary portions and between the same into incorporated movable portions. Supply lines for the gasification medium are associated to the movable portions. In direction of movement of the material to be gasified behind the reactor bottom there is provided an ash discharge including a discharge worm having crushing elements. Above the lower end of the reactor bottom there is provided a water-cooled rotating slag crusher with water-tooled crushing teeth provided on its periphery. Below the lower end of the reactor bottom there is disposed an ash collecting chamber with a discharge worm which likewise has crushing elements on its periphery.

In the case of a slag crusher developed by the applicants for oil or coal gasification plants, which is disposed at the outlet of a radiation cooler or a gasification reactor with chilling or quenching section, the crushing operation takes place in a water bath under the process pressure. Corresponding to the process conditions, the housing of the slag crusher is pressure-proof. The passage of the drive shaft of the cutting knives through the pressure housing has been effected by means of a pressure-tight stuffing box sealing system with sealing water.

The actual crushing operation inside the pressure housing is performed by rotating cutting knives. The stationary cutting knives serve as shoulder or thrust bearing when crushing the large slag lumps by means of the knives disposed on a rotating shaft.

A disadvantage of this slag crusher is the centric arrangement of the shaft in the pressure housing with the rotating knives between the radial and axial inlet baffle plates disposed on both sides and the stationary knives disposed on one side of the radial baffle plates.

The uncrushed and too large slag lumps pile up above the rotating knives and are again and again pushed upwards through the too small opening between the baffle plates provided on both sides and are not supplied to the knives. There is a pile-up of material above the rotating shaft, which leads to an interruption of the flow of material and impairs a controlled crushing and removal of slag.

It is therefore the object underlying the invention to arrange the cutting tools such that both small and large slag pieces are seized completely and a controlled crushing and removal of the slag from the slag crusher is effected.

SUMMARY OF THE INVENTION

The solution of the object is effected in accordance with the main claim; the sub-claims represent advantageous aspects of the invention.

DETAILED DESCRIPTION

Due to the inventive arrangement and design of the rotating and stationary knives a controlled supply of material to the crushing points is ensured. By means of the arrangement and allocation of the cutting and stationary knives and their distances from each other a good crushing result and a high crushing efficiency are achieved.

The stationary cutting knives have a long leg and a short leg. Into the stationary cutting knife a circular recess verging into a straight line has been made on the side of the long leg, and on the side of the short leg only a circular recess has been made, based on the vertical center line of the pressure vessel.

The stationary cutting knives are releasably mounted on brackets inside the pressure vessel; the dimensions of the long and short legs depend on the location of the stationary knife with respect to the outer wall of the pressure vessel, where the length of each stationary knife depends on the arrangement with respect to the center line and on the arrangement with respect to the round wall of the pressure vessel in the cutting position inside the pressure vessel.

Both the cutting and the stationary knives are exposed to an enormous wear in the cutting area. Therefore, these areas are provided with a wear protection. This wear protection can be achieved by means of a build-up weld or a mechanically applied wear protection. Of course, all knives can also be replaced as a complete unit, when a prolonged wearing operation has lead to a wear of the knife bodies.

The passages of the drive shaft through the pressure vessel are sealed by means of special stuffing boxes with a lubricating or rinsing system. The support and the drive of the drive shaft are disposed outside the pressure vessel. The shaft extending through the pressure vessel is disposed at a distance "a" from the vertical or horizontal center line.

The invention will now be explained in detail with reference to an embodiment, wherein:

Figure 1:
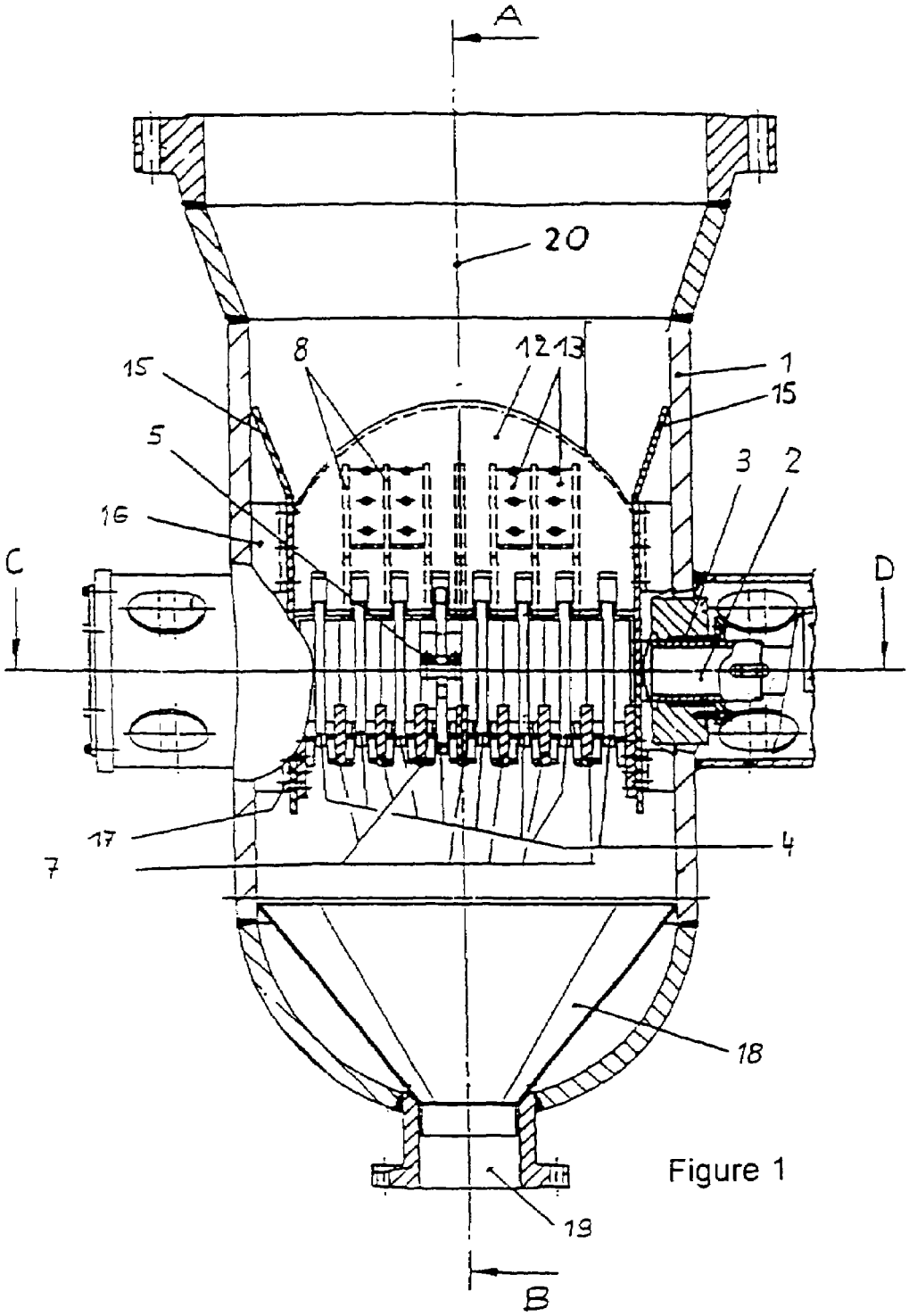
FIG. 1 shows a vertical section through a slag crusher in the sectional plane of the drive shaft.
Figure 2:
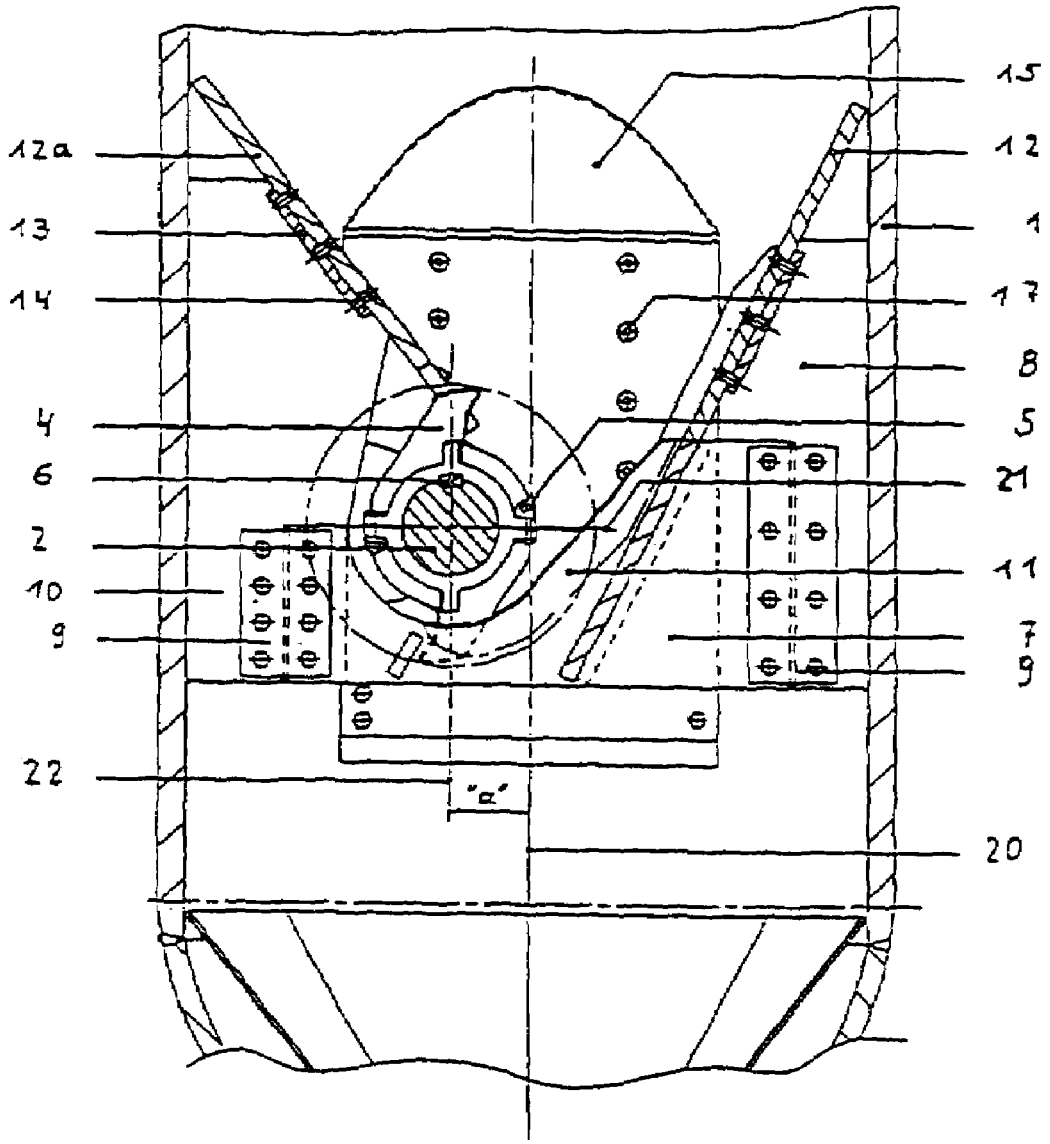
FIG. 2 shows a section A-B through the slag crusher.

As is represented in FIG. 1 and FIG. 2, the slag crusher consists of the pressure vessel 1, the drive shaft 2, stuffing boxes 3 provided on both sides, the rotating knives 4 mounted on the shaft as well as the stationary knives 7 disposed below/between the inlet baffle plates 12, 12*a* and the baffle plates of the feeding hopper 12, 15. The material to be crushed is supplied to the crushing area via the baffle plates of the feeding hopper 12, 15.

In accordance with FIG. 2, the drive shaft 2 is disposed eccentrically or off-center at a distance "a" from the vertical center line 20 of the slag crusher, so that the crushing area is concentrated in the middle of the slag crusher. In this way, a uniform load of the fixture 5 of the rotating knives 4 is achieved as well as a central discharge of the crushed material.

On the drive shaft 2, which is passed through the pressure vessel 1 by means of a stuffing box sealing 3, the rotating cutting knives 4 are disposed. As a halved version, the rotating cutting knives 4 are fixedly connected with the drive shaft 2 by means of fastening screws 5 and a feather key 6. When crushing the material to be crushed, the crushing shoulders of the rotating cutting knives 4 form the stationary cutting knives 7 protruding through the inlet baffle plate 12, which stationary cutting knives are provided with a wear-resistant build-up weld 11. They are each mounted individually on mounting brackets 8, 10 by means of fastening screws 9.

The rotating cutting knives 4 are angularly offset in a known manner on the periphery of the shaft 2, so that it is achieved that during the crushing operation only one rotating knife 4 and two stationary knives 7 are each in engagement with each other as crushing shoulder or pairs of knives 7, and the further knives 4 are used only subsequently. When designing the motor, the crushing force of only one rotating cutting knife 4 should therefore be considered.

An essential feature of the inventive apparatus consists in that all interior cutting members 4, 7, which are exposed to wear, can quickly be replaced if necessary.

The crushed material is discharged from the slag crusher via the cone 18 and the outlet port 19 and supplied to a disposal site.

Figure 3:
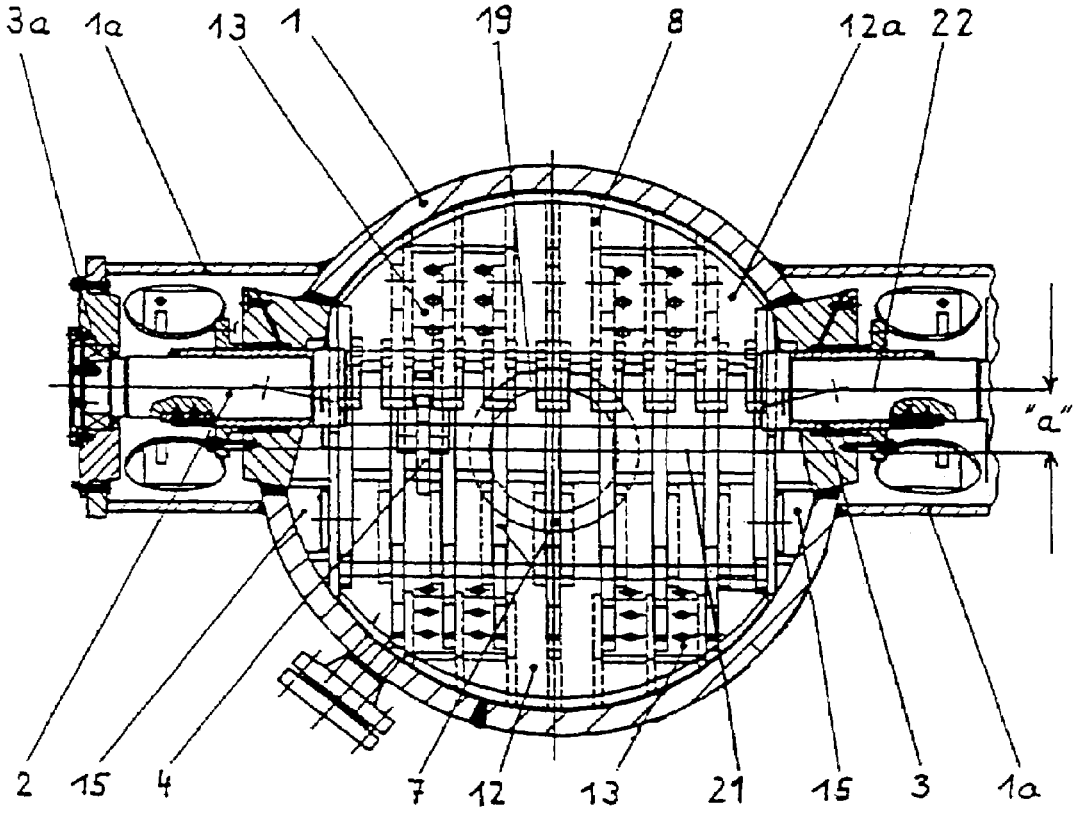
FIG. 3 shows a horizontal section C-D through the slag crusher in the sectional plane of the drive shaft.

FIG. 3 shows a horizontal section C-D through the slag crusher in the sectional plane of the drive shaft 2. The drive shaft 2 is supported in two lateral ports 1*a* in roller bearings 3*a* and secured against escaping pressurized water by means of sealing elements 3.

The shaft 2 with the rotating cutting knives 4 is disposed inside the pressure housing 1 off-center or eccentrically at a distance "a" from the horizontal center line 21 of the pressure vessel 1.

The stationary cutting knives 7 are provided in slots of the inlet baffle plates 12, which in turn are mounted at brackets 8 and 13. In the vicinity of the sealing 3 near the wall of the housing 1 there are provided inlet baffle plates 15 offset by 90°. The inlet baffle plates 12 and 15 form the so-called feeding or material hopper for the cutting knives 4, 7.

Figure 4:
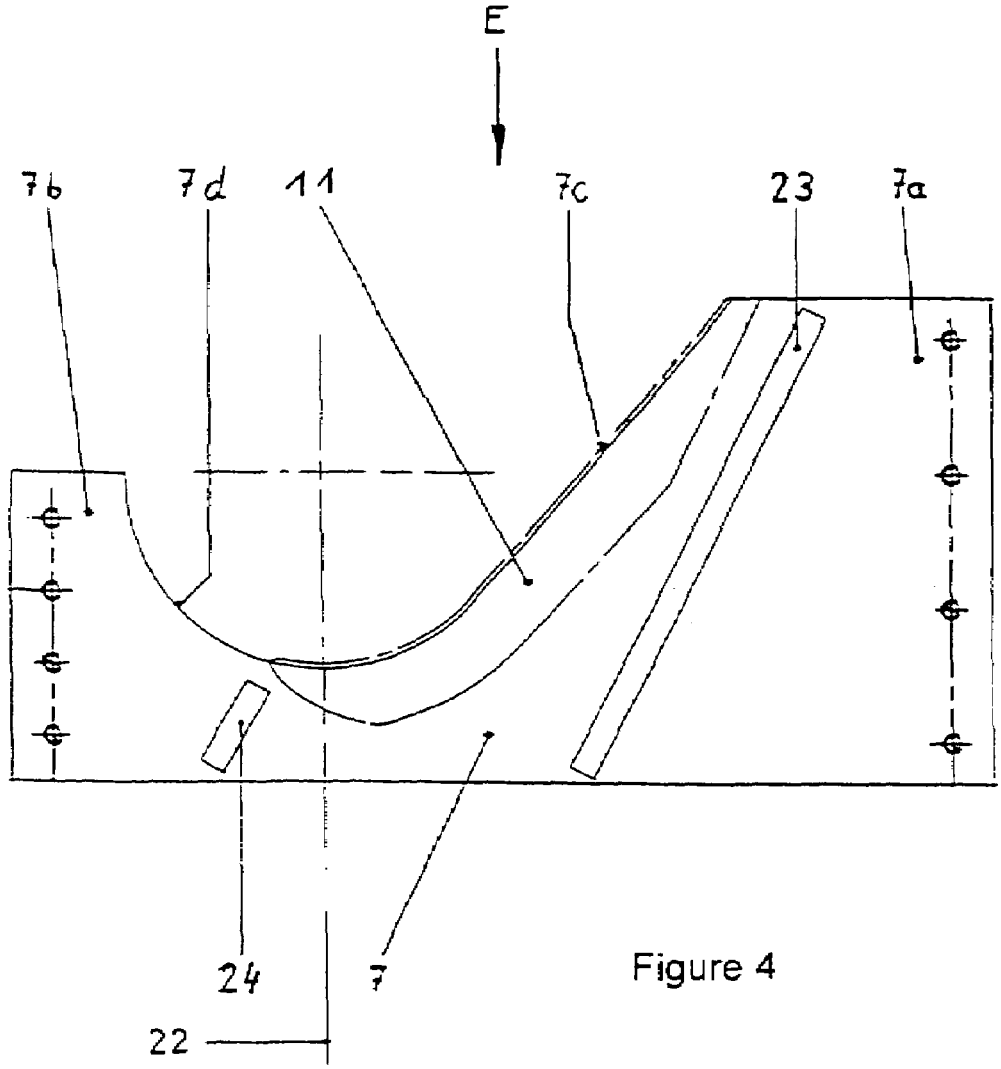
FIG. 4 shows a side view of a stationary cutting knife.

FIG. 4 shows a side view E of a stationary cutting knife 7 with a long leg 7*a* and a short leg 7*b*, which on the first-mentioned side 7*a* has a circular recess 7*d* verging into a straight line 7*c*, and on the last-mentioned side 7*b* only has a circular recess 7*d*, based on the vertical center line 22 of the shaft 2.

On both legs 7*a*, 7*b* guiding strips 23, 24 are provided. The straight portion 7*c* of the stationary cutting knife 7 is provided on its reverse side with a build-up weld or wear-resistant coating 11.

Figure 5:
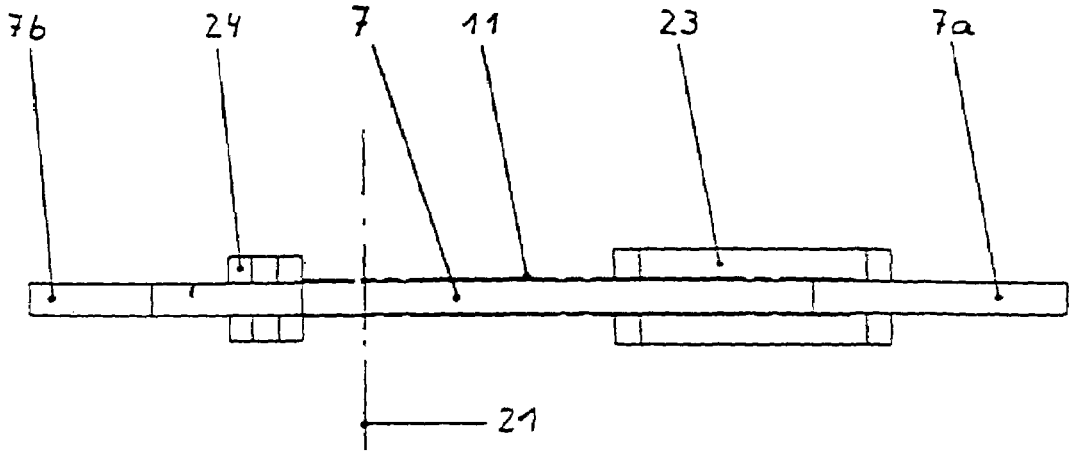
FIG. 5 shows a view E of a stationary cutting knife.

FIG. 5 shows a view E of the stationary cutting knife 7 with a long leg 7*a* and a short leg 7*b*, based on the horizontal center line 21 of the shaft 2. On both sides of the stationary cutting knives 7 guiding strips 23, 24 are provided.

List of Reference Numerals:

| | |
|---|---|
| 1 | pressure housing |
| 1a | port |
| 2 | shaft |
| 3 | sealing |
| 3a | roller bearing |
| 4 | rotating cutting knife |
| 5 | fixture of the rotating cutting knife |
| 6 | feather key |
| 7 | stationary cutting knife |
| 7a | long leg |
| 7b | short leg |
| 7c | straight portion |
| 7d | circular recess |
| 8 | mounting bracket for stationary cutting knives |
| 9 | fastening means |
| 10 | mounting bracket for stationary cutting knives |
| 11 | build-up weld/wear-resistant coatings |
| 12 | inlet baffle plate |
| 12a | slotted inlet baffle plate |
| 13 | mounting bracket for inlet baffle plate |
| 14 | fastening screws |
| 15 | inlet baffle plate |
| 16 | mounting bracket for inlet baffle plate |
| 17 | fastening screws |
| 18 | cone |
| 19 | slag crusher outlet |
| 20 | vertical center line of 1 |
| 21 | horizontal center line of 1 |
| 22 | vertical center line of 2 |
| 23 | guiding strips |
| 24 | guiding strips |

"a" distance between 20 and 22

The invention claimed is:

1. A slag crusher, comprising a pressure housing, a rotatable shaft extending through the pressure housing and including a plurality of cutting knives mounted thereon at a distance and rotating in operation, which cutting knives are mounted on the shaft so as to be angularly offset, comprising a plurality of stationary cutting knives disposed one beside the other below the shaft, where in the area of the crusher each rotating cutting knife extends between two adjacent stationary cutting knives, characterized in that in the pressure housing inclined inlet baffle plates are disposed and form an inlet funnel directed towards the area of the crusher, that the shaft is disposed at a distance (a) from the vertical center line of the pressure housing, that each stationary cutting knife is formed with a long leg (7*a*) and a short leg (7*b*) located between a circular recess, and that the long leg is disposed in a slot of an inlet baffle plate.

2. The slag crusher as claimed in claim 1, characterized in that the rotating and the stationary cutting knives are releasably mounted.

3. The slag crusher as claimed in claim 1, characterized in that the rotating and the stationary cutting knives have wear-resistant coatings in the areas exposed to wear.

* * * * *